US006462765B1

(12) United States Patent
Conwell et al.

(10) Patent No.: US 6,462,765 B1
(45) Date of Patent: Oct. 8, 2002

(54) ON-DEMAND THERMAL TRANSFER PRINTER/LAMINATOR FOR SUB-SURFACE PRINTED LABELS

(75) Inventors: Kevin Girard Conwell, Fairfield, OH (US); Pixie Ann Austin, Marysville, WA (US)

(73) Assignee: Intermec IP Corporation, Woodland Hills, CA (US)

( * ) Notice: Subject to any disclaimer, the term of this patent is extended or adjusted under 35 U.S.C. 154(b) by 0 days.

(21) Appl. No.: 09/598,080

(22) Filed: Jun. 21, 2000

(51) Int. Cl.[7] ..... B41J 2/32

(52) U.S. Cl. ..... 347/171; 347/212; 156/384; 156/387

(58) Field of Search ..... 156/387, 384; 347/171, 173, 212

(56) References Cited

U.S. PATENT DOCUMENTS 4,068,028 A 1/1978 Samonides ..... 428/40
4,385,302 A * 5/1983 Moriguchi et al. ..... 347/173
5,103,583 A 4/1992 VanErmen ..... 40/638
5,193,926 A * 3/1993 Kuzuya et al. ..... 156/384
5,225,260 A 7/1993 McNaul et al. ..... 428/40
5,443,318 A * 8/1995 Kitazawa ..... 400/120.01
5,676,785 A 10/1997 Samonides ..... 156/244
5,827,389 A 10/1998 Takizawa et al. ..... 156/234

OTHER PUBLICATIONS

3M Laminating Adhesives/Data Page—*Scotch™ 9452, 9459W and 9459S Laminating Adhesives For Label Component Systems*, technical data sheet FOD #0058.

3M Label Stocks/Data Page—Scotch™ 7866 Tamper–Indicating Label Stock For Thermal Transfer Printing, technical data sheet FOD #0095.

* cited by examiner

*Primary Examiner*—Huan Tran
(74) *Attorney, Agent, or Firm*—Orum & Roth

(57) ABSTRACT

An on-demand subsurface printed label. Indicia is reverse printed on the back of a clear plastic label film. Resulting label is suitable for harsh environments without requiring pre-printing or use of an extra protective outer layer.

7 Claims, 2 Drawing Sheets

ON-DEMAND THERMAL TRANSFER PRINTER/LAMINATOR FOR SUB-SURFACE PRINTED LABELS

BACKGROUND OF THE INVENTION

1. Field of the Invention

This invention is in the field of thermal transfer printers/laminators, specifically on-demand thermal transfer printers/laminators for sub-surface printed labels.

2. Description of Related Art

Previously, sub-surface graphics labels were pre-printed weeks or months in advance on an offset, gravure, screen, or flexographic printing press. A representative example of these printing processes is contained in U.S. Pat. No. 04,068,028. Unfortunately, as the previous labels were pre-printed, the required information may have changed by the time the labels are required to be put into use. Especially useful is the on-demand production of labels with identifying bar codes or serial numbers for work in progress or unique, custom items. A common application of these labels is the under hood affixation in an automobile. The various oils, greases, gasoline, anti-freeze, brake fluid, wiper solvent, and engine shampoo, commonly encountered under the hood of an automobile can be expected to degrade a surface unprotected label. Previously, these labels would be on-demand printed and then protected with an additional clear over-laminate film. The present invention allows on-demand custom labels produced at the site of use which do not require an over-laminate film. Cost savings include the use of less expensive print ribbons and the removal of the requirement for an over-laminate film.

SUMMARY OF THE INVENTION

The invention is a desk top or portable on-demand thermal transfer printer/laminator for sub-surface printed labels. Indicia is reverse-printed on a clear plastic label film and then a laminator affixes an adhesive and liner to the reverse-printed clear label film. As the label exits the printer, it may be individually cut or cut and stacked. If desired, the label may be distributed linerless from the machine ready for final affixation to the object. Various tamper-indicating features may be used either in the clear label film or in the adhesive liner. Depending upon the application, the adhesive is a contrasting color to the printing. In the example of black printing, it would be a white pigmented adhesive. If there is enough contrast upon the intended object, clear adhesive may be used.

DETAILED DESCRIPTION OF THE INVENTION

Figure 1:
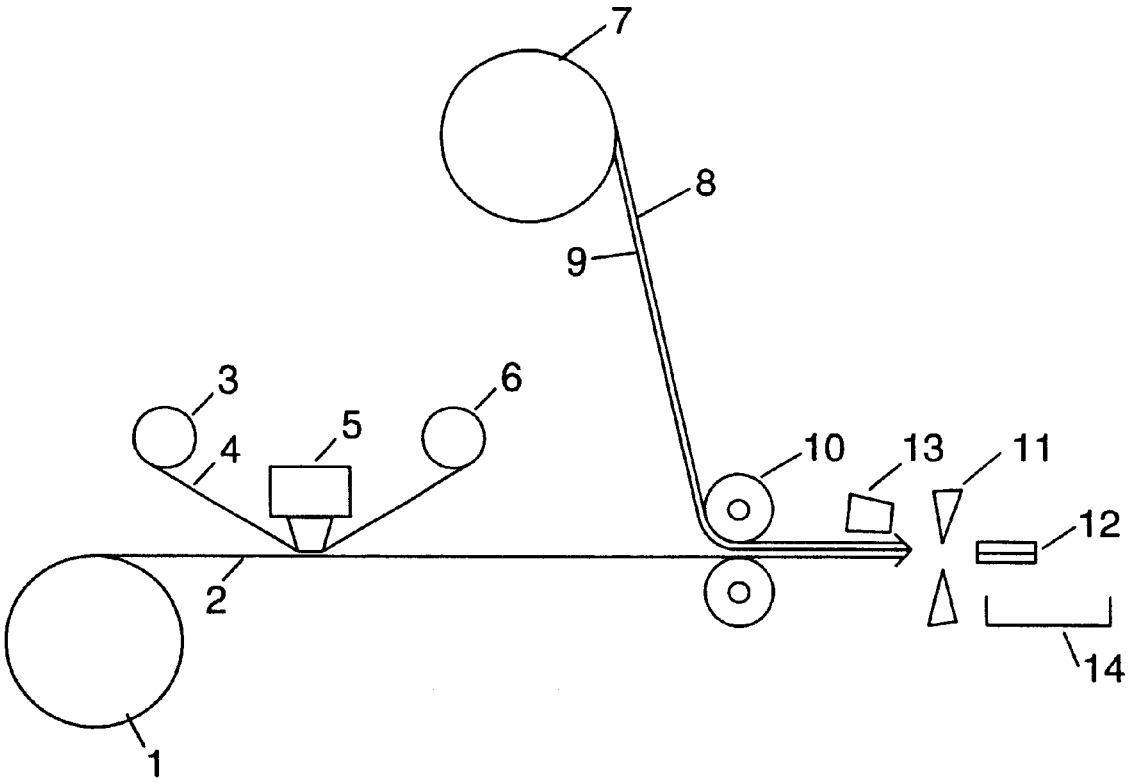
FIG. 1 is a schematic of the printer.
Figure 2:
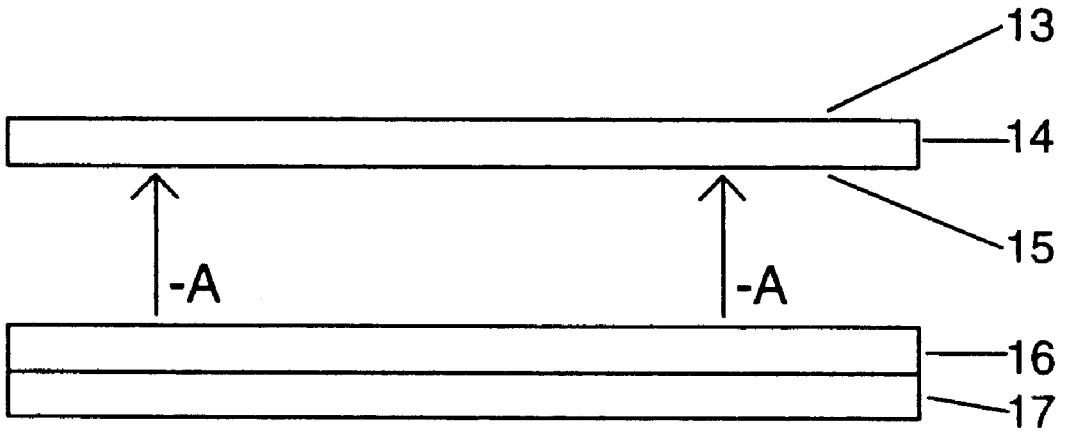
FIG. 2 is a schematic side view of the reverse-printed label.

Clear label film is supplied in roll form to the printer. The clear label film roll (1) supplies film to the print head (5). The film may be any clear plastic film that can accept thermal transfer ribbon ink such as Flexcon 2 mil. polyester PM-200-C TC390. Other clear films such as polypropylene, polyethylene, vinyl, polystyrene, polyolefin, polyamide, or blends of these may be used, with varying thickness depending upon the level of environmental resistance required. The clear label film (2) passes the print head (5) with the print receptive side facing the print head. A printer has print film supplied in roll form. The print ribbon roll (3) supplies print ribbon (4) past the print head (5) which prints onto the reverse side of the clear label film (2). Reverse printing is possible using printer engines utilizing third generation Intermec Programming Language (IPL3). The print ribbon (4), after printing, is taken up upon the used print ribbon roll (6). The printed clear label film (2) is laminated to an adhesive liner. Adhesive with liner is supplied in a roll. Adhesive with liner roll (7) supplies adhesive (9) with liner (8) to pressure roller/laminator (10). The printed laminated label is fed to a cutter (11) which cuts the finished label (12). The printer may be supplied with a tray (14) where printed labels are collected and stacked, or a liner separation system (13) which presents a label ready for immediate application.

In another embodiment, the printer head (5) is of ink jet type. Multiple thermal transfer or ink jet print head stations could be utilized to generate color printing utilizing a separate print head for each color. The cutter (11) may be either rotary or guillotine type.

Tamper resistant labels may be produced if special films or adhesives are used. One example of a tamper resistant film is 3M 7866 which, when the label's clear film is separated, leaves behind stuck adhesive or separated label material spelling "VOID". Another technique is the use of cast vinyl which tears apart rather then separating as a single piece. Also, durable "tags" may be produced if an adhesive with a permanent backing is used.

The present invention is entitled to a range of equivalents, and is to be limited only by the scope of the following claims.

We claim:

1. An on-demand printer/laminator for sub-surface printed labels, comprising:

a clear label film having top and bottom sides, a print head, an adhesive with liner having adhesive and liner sides, a laminator, a cutter, a stacking tray said stacking tray collects the finished labels as they exit said cutter said clear label film's bottom side is reverse printed by said print head, said reverse printed clear label films bottom side is laminated to said adhesive side by passage through said laminator, and cut into separate, ready for use labels, by said cutter.

2. An on-demand printer/laminator for sub-surface printed labels, comprising:

a clear label film having top and bottom sides, a print head, an adhesive with liner having adhesive and liner sides, a laminator, a cutter, a liner stripping mechanism, said clear label film's bottom side is reverse printed by said print head, said reverse printed clear label film's bottom side is laminated to said adhesive side by passage through said laminator, and said liner stripping mechanism peels the liner from the finished label, said cutter cuts the labels into separate, ready for use labels, presenting the finished label to a user ready for immediate application.

3. The printer/laminator of claim 2, wherein said cutter is rotary.

4. The printer/laminator of claim 2, wherein said cutter is guillotine type.

5. An on-demand printer/laminator for sub-surface printed labels, comprising:

a clear label film having top and bottom sides, a print head, an adhesive with liner having adhesive and liner sides, a laminator, a cutter, said clear label film's bottom side is reverse printed by said print head, said clear label film has means for visible evidence of label tampering, said reverse printed clear label film's bottom side is laminated to said adhesive side by passage through said laminator, and cut into separate, ready for use labels, by said cutter.

6. An on-demand printer/laminator for sub-surface printed labels, comprising:

a clear label film having top and bottom sides, a print head, an adhesive with liner having adhesive and liner sides, a laminator, a cutter, said clear label film's bottom side is reverse printed by said print head, said adhesive has means for visible evidence of label tampering, said reverse printed clear label film's bottom side is laminated to said adhesive side by passage through said laminator, and cut into separate, ready for use labels, by said cutter.

7. An on-demand printer/laminator for sub-surface printed labels, comprising:

a clear label film having top and bottom sides, a print head, an adhesive with liner having adhesive and liner sides, a laminator, a cutter, said clear label film's bottom side is reverse printed by said print head, said adhesive liner is not separable from said adhesive, said reverse printed clear label film's bottom side is laminated to said adhesive side by passage through said laminator, and cut into separate, ready for use labels, by said cutter.

* * * * *